US008353663B2

(12) United States Patent
Arzel et al.

(10) Patent No.: US 8,353,663 B2
(45) Date of Patent: Jan. 15, 2013

(54) SHROUD SEAL SEGMENTS ARRANGEMENT IN A GAS TURBINE

(75) Inventors: Tanguy Arzel, Ennetbaden (CH); Thomas Heinz-Schwarzmaier, Wettingen (CH); Martin Schnieder, Ennetbaden (CH)

(73) Assignee: ALSTOM Technology Ltd, Baden (CH)

( * ) Notice: Subject to any disclaimer, the term of this patent is extended or adjusted under 35 U.S.C. 154(b) by 0 days.

(21) Appl. No.: 13/011,203

(22) Filed: Jan. 21, 2011

(65) Prior Publication Data

US 2011/0171013 A1 Jul. 14, 2011

Related U.S. Application Data

(63) Continuation of application No. PCT/EP2009/058895, filed on Jul. 13, 2009.

(30) Foreign Application Priority Data

Jul. 22, 2008 (CH) ..... 1146/08

(51) Int. Cl.
*F04D 29/38* (2006.01)

(52) U.S. Cl. ..... 415/115; 415/139

(58) Field of Classification Search ..... 415/115, 415/116, 134, 139, 173.1
See application file for complete search history.

(56) References Cited

U.S. PATENT DOCUMENTS

| | | | | |
|---|---|---|---|---|
| 4,573,865 | A | 3/1986 | Hsia et al. | |
| 5,538,393 | A * | 7/1996 | Thompson et al. | 415/115 |
| 2003/0131980 | A1 | 7/2003 | Demarche et al. | |
| 2003/0133790 | A1 | 7/2003 | Darkins et al. | |
| 2004/0219009 | A1 | 11/2004 | Marchi et al. | |
| 2006/0140753 | A1 * | 6/2006 | Romanov et al. | 415/173.1 |
| 2009/0035125 | A1 | 2/2009 | Fujimoto et al. | |

FOREIGN PATENT DOCUMENTS

| | | | |
|---|---|---|---|
| DE | 19619438 | A1 | 11/1997 |
| EP | 1124039 | A1 | 8/2001 |
| EP | 1176285 | A2 | 1/2002 |
| EP | 1455055 | A1 | 9/2004 |
| EP | 1500789 | A1 | 1/2005 |
| EP | 1676981 | A2 | 7/2006 |
| EP | 1905951 | A2 | 4/2008 |
| EP | 1930549 | A2 | 6/2008 |
| WO | 2007099895 | A1 | 9/2007 |

* cited by examiner

*Primary Examiner* — Dwayne J White
(74) *Attorney, Agent, or Firm* — Volpe and Koenig, P.C.

(57) ABSTRACT

A gas turbine is provided that includes a rotor which is rotatable around an axis and equipped with rotor blades, and which is concentrically enclosed at a distance by a casing, which is equipped with stator blades, forming an annular hot gas passage. Rings with stator blades and rotor blades are arranged in a manner alternating in the axial direction. Between adjacent stator blades, heat shield segments are arranged, which delimit the hot gas passage on the outside in a region of the rotor blades and are cooled by impingement cooling where a cooling medium from an outer annular cavity flows into the heat shield segment.

13 Claims, 5 Drawing Sheets

Fig.5

SHROUD SEAL SEGMENTS ARRANGEMENT IN A GAS TURBINE

CROSS REFERENCE TO RELATED APPLICATION

This application is a continuation of International Application No. PCT/EP2009/058895 filed Jul. 13, 2009, which claims priority to Swiss Patent Application No. 01146/08, filed Jul. 22, 2008, the entire contents of all of which are incorporated by reference as if fully set forth.

FIELD OF INVENTION

The present invention relates to the field of thermal machines, in particular, gas turbines.

BACKGROUND

Gas turbines, as are described for example in printed publication DE-A1-196 19 438, in the turbine section have a rotor which is provided with rotor blade rows and is concentrically enclosed at a distance by a casing. Rings are formed on the casing and carry stator blades which, in common with the rotor blades on the rotor, extend into the hot gas passage which is formed between rotor and casing. Stator blade rows and rotor blade rows alternate in the axial direction or in the direction of the hot gas flow. Heat shield segments, which the rotor blades move past by their blade tips, and which are supplied with cooling air or another cooling medium from an annular cavity which encompasses the heat shield segments, are arranged in a circumferentially distributed manner between adjacent stator blade rows towards the outer limit of the hot gas passage. For cooling, an impingement cooling method, for example, is used, in which the cooling medium, through repeatedly applied openings in an impingement cooling plate, impinges upon the inner side of the wall, which delimits the hot gas passage, of the heat shield segment.

The heat shield segments ("heat shields") behind the front-stage stator blades of the turbine are exposed to high heat-flow loads. In the region where the rotor blades rotate past, high heat-flow loads occur. High heat-flow loads also occur in the region of the stator blade wake. Wake pressure waves, which are associated with the wake, reduce the pressure margin (back flow margin BFM), i.e. the available pressure difference between hot gas passage and annular cavity, with regard to a hot-gas intrusion.

A "failsafe design" with regard to rubbing (rubbing cracks), loss of sealing (inter heat shield feather seals), part load, ambient conditions (off-ISO design), damage as a result of impact (FOD, i.e. foreign-object damage) and manufacturing tolerances, require an appreciable margin regarding BFM, which at ISO full-load conditions has a negative effect upon the performance.

The number of stator blades in the ring, in the case of conventional solutions, is independent of the number of associated heat shield segments. The number of parts is minimized as far as possible. Since the thermal and mechanical loads of the stator blades are higher, a larger number of stator blades are required in comparison to the number of heat shield segments.

SUMMARY

The present disclosure is directed to a gas turbine including a rotor that is rotatable around an axis and equipped with rotor blades. The rotor is concentrically enclosed at a distance by a casing. The casing is equipped with stator blades, forming an annular hot gas passage. Rings including the stator blades and the rotor blades are arranged in an alternating manner in an axial direction. Between adjacent stator blades heat shield segments are arranged, which delimit the hot gas passage on its outside in a region of the rotor blades and are cooled by impingement cooling where a cooling medium from an outer annular cavity flows into the heat shield segment. The number of heat shield segments and adjacent stator blades in the rings is the same.

BRIEF DESCRIPTION OF THE DRAWINGS

The invention shall subsequently be explained in more detail based on exemplary embodiments in conjunction with the drawing. All elements which are not essential for the direct understanding of the invention have been omitted. Like elements are provided with the same designations in the various figures. The flow direction of the media is indicated by arrows. In the drawing

DETAILED DESCRIPTION OF THE PREFERRED EMBODIMENTS

Introduction to the Embodiments

Figure 1:
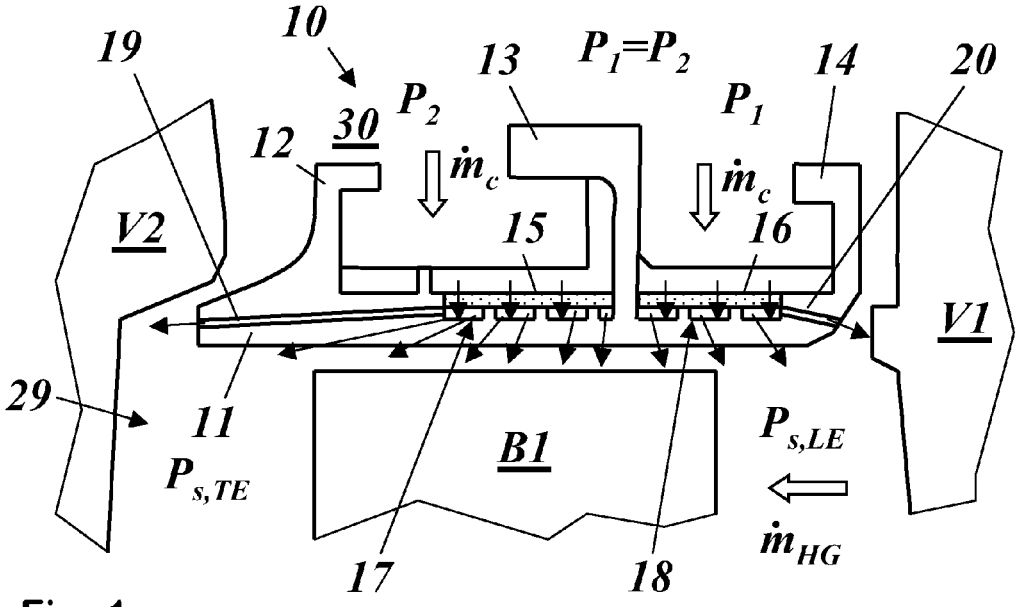
Fig. 1 (Prior Art)
FIGS. 1-3 show, in a simplified view in longitudinal section, a detail from a gas turbine with heat shield segments which are arranged between the first and second stator blade row and are cooled by means of a simple impingement cooling scheme (FIG. 1), a sequential impingement cooling scheme (FIG. 2), and an impingement cooling scheme which operates with counterflow.

The invention provides a remedy for the above-noted drawbacks. It is therefore the object of the invention to create a gas turbine with impingement-cooled heat shield segments which avoids the disadvantages of known solutions and in particular to reduce the consumption of cooling medium.

The object is achieved by means of the entirety of the features of claim 1. It is preferable that the number of heat shield segments and adjacent stator blades in the rings is the same. As a result of this, maximum occurring loads can be addressed locally, i.e. by means of local cooling. Margins and overall consumption of cooling medium can be appreciably reduced. This allows higher temperatures and a lower cooling medium requirement for a better performance and also flatter temperature profiles for lower emissions.

In one embodiment, two impingement cooling cavities, into which flows the cooling medium from the annular cavity, are arranged in each case in the heat shield segment in series in the axial direction, in that the downstream-disposed impingement cooling cavity is separated from the annular cavity and both annular cavities are exposed to admission of the cooling medium at the same pressure, wherein the heat shield segments in each case have a middle, hook-like fastening element, the two impingement cooling cavities are separated from each other by means of the middle fastening element, and the downstream-disposed impingement cooling cavity is separated from the annular cavity by means of a cover plate which is arranged between the impingement cooling cavity and the annular cavity.

In another embodiment, a multiplicity of pillars are arranged in a distributed manner in the impingement cooling cavities for increasing the transfer of heat, wherein the multiplicity of pillars comprise spacers for the impingement cooling plates and cooling pins for increasing the transfer of heat between cooling medium and heat shield segment, and wherein the pillars are accommodated in the impingement cooling cavities in arrangements which are regular at least in sections, and the spacers and cooling pins are arranged in a staggered manner in relation to each other.

In a further embodiment, the heat shield segments have a leading edge, a trailing edge and two side sections in each case with regard to the flow of the hot gas, and in that for film cooling of the edges and side sections of the heat shield segment, provision is made for cooling holes which, extending from the impingement cooling cavities, pass through the heat shield segment to all sides and terminate in the outer space. In particular, the cooling holes which terminate on the oppositely disposed side sections of the heat shield segment are arranged in this case in a staggered manner in relation to each other so that the discharging cooling medium in adjoining heat shield segments is not mutually impeded at the outlet.

Furthermore, it is advantageous if for unimpeded discharging of the cooling medium the cooling holes at the leading edge and in the side sections terminate in a set-back manner in a recess, and if the cooling holes in the region of the corners of the heat shield segment are formed in a flared manner for improved cooling of the edge regions.

In another embodiment, each heat shield segment and the associated upstream-disposed stator blade are positioned relative to each other in the circumferential direction so that the wake pressure wave which is created by the stator blade can be compensated by a means of a corresponding arrangement and supply of the cooling holes in question, wherein the cooling holes lying in the region of the wake pressure wave above the impingement cooling plates lead into the impingement cooling cavities.

Detailed Description

Figure 2:
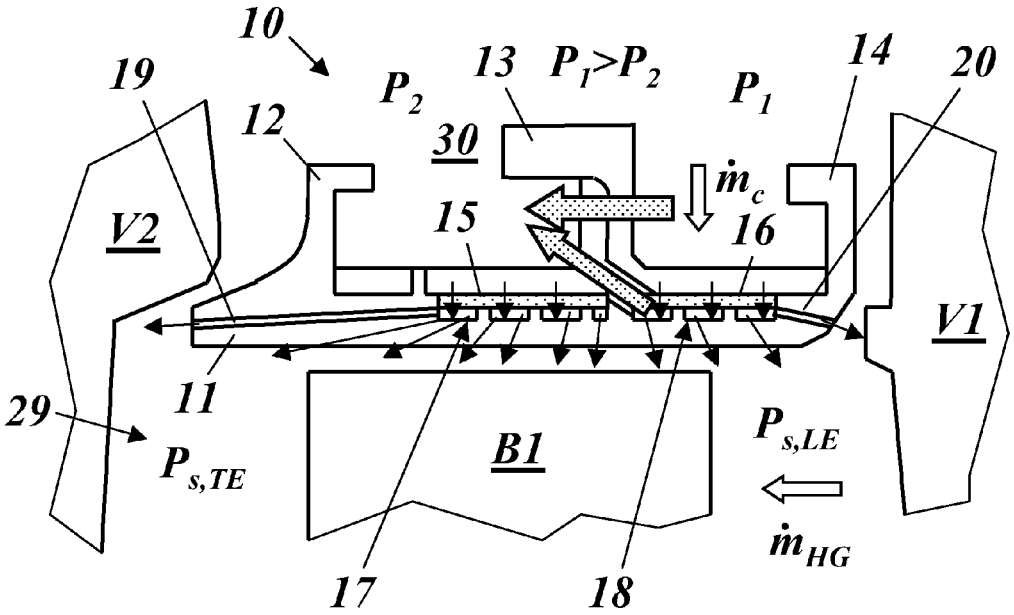
Fig. 2 (Prior Art)
Figure 3:
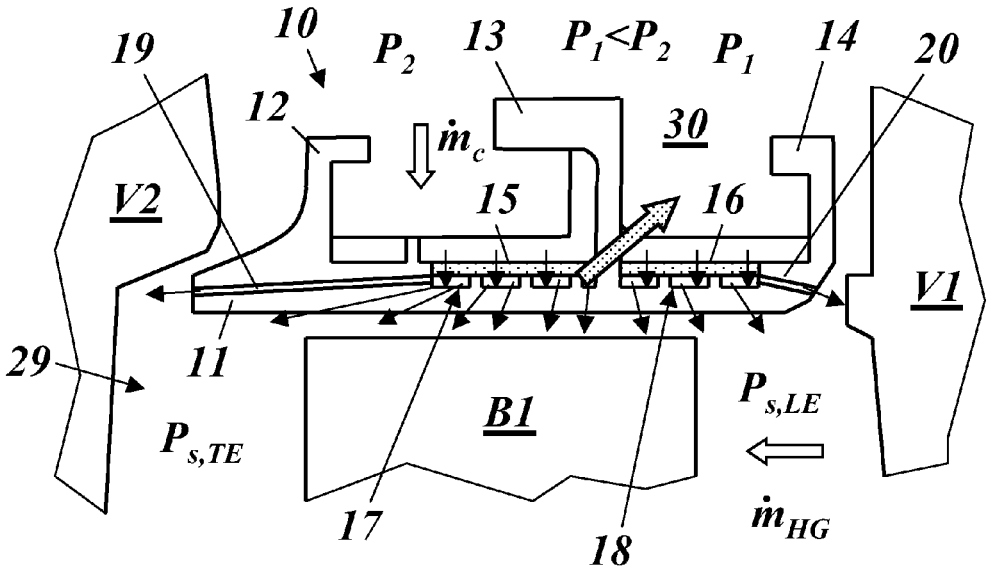
Fig. 3 (Prior Art)

In FIGS. 1 to 3, in a simplified view, different impingement-cooling schemes in a gas turbine 10 are exemplified, based on the heat shield segments 11 which are arranged opposite the first rotor blades B1 between the first stator blades V1 and the second stator blades V2. In the hot gas passage 29, hot gas flows from right to left with a mass flow density $\dot{m}_{HG}$, wherein at the leading edge (LE) of the rotor blade B1, a pressure $P_{s,LE}$ prevails, and at the trailing edge (TE), a pressure $P_{s,TE}$ prevails. The hot gas passage 29 is delimited in the region of the rotor blade B1 on the outside by the heat shield segment 11 which is fastened on a casing (not shown) by means of hook-like fastening elements 12, 13, 14. The heat shield segment 11 is encompassed on the outside by an annular cavity 30 from which a cooling medium, as a rule cooling air, under pressure $P_1$ or $P_2$, flows into two corresponding impingement cooling cavities 17, 18 via perforated impingement cooling plates 15, 16, cools the heat shield segment there by means of impingement cooling and then discharges through cooling holes 19, 20 into the hot gas passage 29.

In the simple case of FIG. 1, $P_1=P_2$, so that the cooling medium flows into the two impingement cooling cavities with the same mass flow density $\dot{m}_c$. In order to maintain the necessary pressure margin in the case of different pressures in the hot gas passage, operation must be carried out with a very large pressure difference over the entire length of the heat shield segment 11. The leakage losses are therefore high.

In the case of the sequential impingement cooling scheme of FIG. 2, this disadvantage is corrected by $P_1>P_2$ being selected. However, as a result of possible crossflows between the impingement cooling cavities 15, 16 (upper broader arrow in FIG. 2), the system is sensitive to the seals (not shown) which are provided on the end face of the fastening element 13 for sealing the gaps between adjacent heat shield segments.

In the case of the counterflow-impingement cooling scheme of FIG. 3, this is corrected by $P_1<P_2$ being selected. However, in this case setting the pressure margin in relation to the wake maximum of the pressure proves to be critical.

Figure 4:
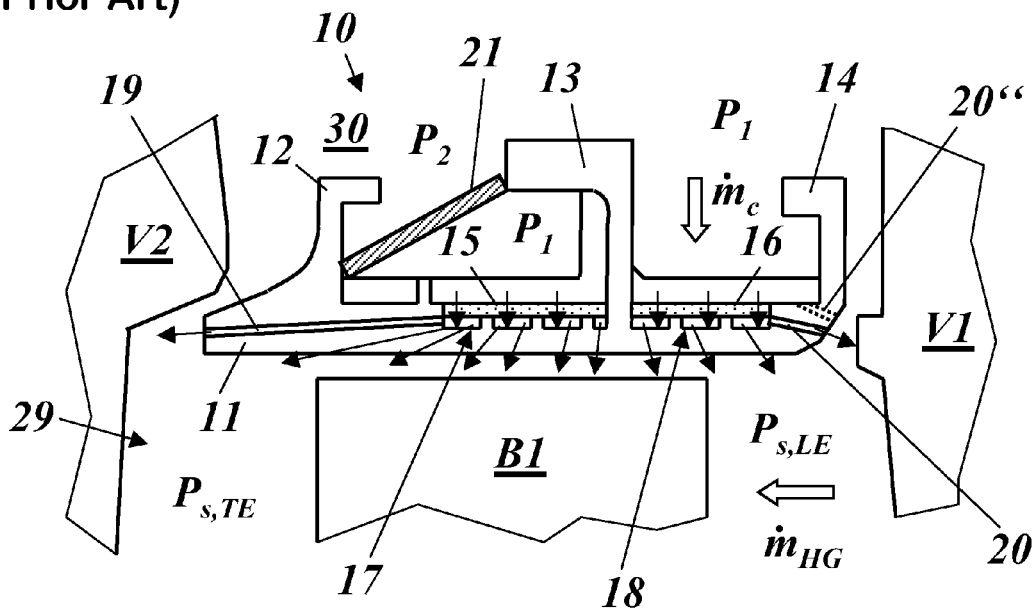
FIG. 4 shows in a view comparable to FIGS. 1-3 an impingement cooling scheme according to an exemplary embodiment of the invention.

In FIG. 4, in a view which is comparable to FIGS. 1 to 3, an exemplary embodiment of the invention is reproduced. In this case, the same number of parts in the ring for the stator blades V1 and the heat shield segments 11 is assumed. The heat shield segment 11 has two impingement cooling cavities 17 and 18 which are separated from each other by means of the middle hook-like fastening element 13 and are operated with the same pressure $P_1$. The second, downstream-positioned impingement cooling cavity 17 is isolated from the annular cavity 30 by means of a cover plate 21. The pressure margin for the impingement cooling and pressure margin for the spring seals between adjacent segments can be set independently of each other. A loss of sealing no longer leads to lowering of the cooling medium pressure. The margin of the cooling medium pressure can be reduced. The pressure above the cover plate 21 ($P_2$) can be set so that the moving past of the rotor blade B1 does not create oscillation of the seal and therefore sealing failures also do not occur.

Figure 5:
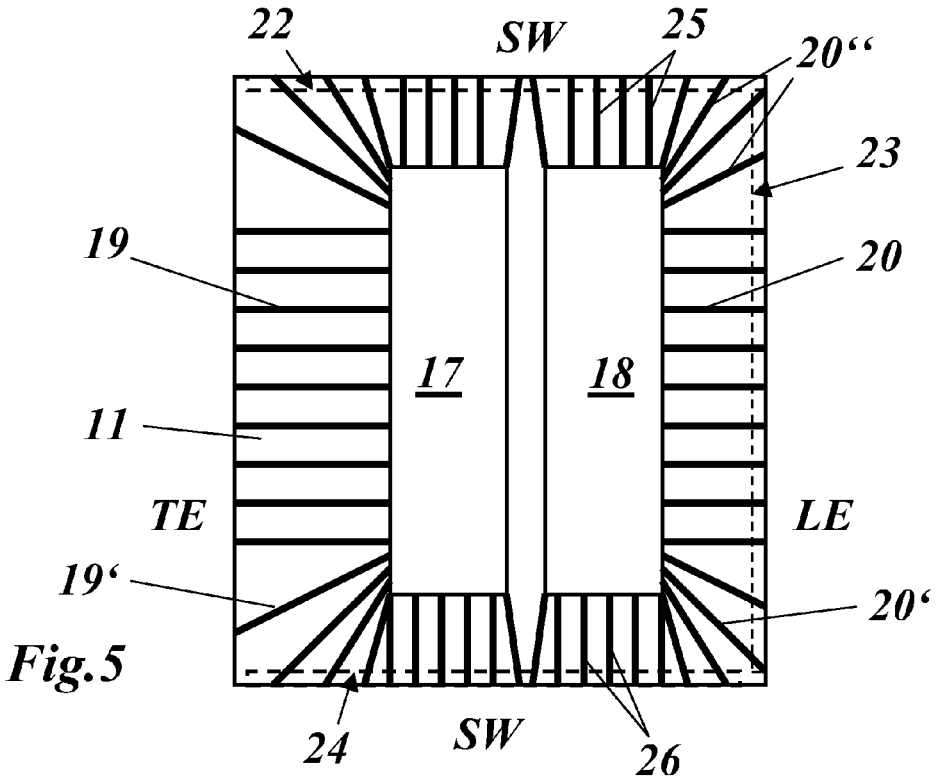
FIG. 5 shows a heat shield segment which is suitable for the arrangement according to FIG. 4, with the arrangement of the various cooling holes and recesses in plan view from the outside.
Figure 6:
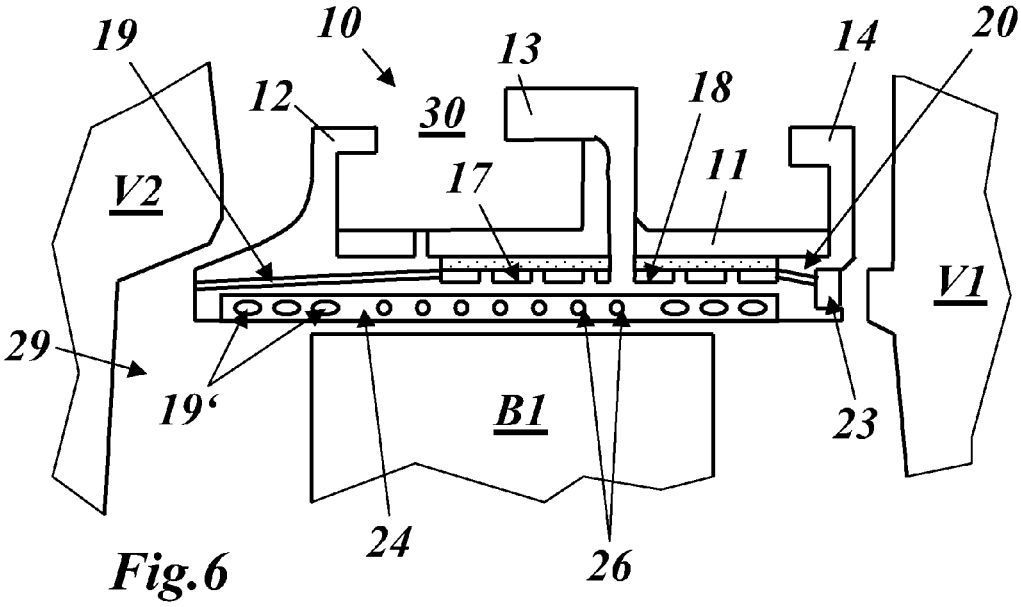
FIG. 6 shows in a view comparable to FIG. 4 the installed heat shield segment according to FIG. 5.

For improving the cooling of the heat shield segment 11, provision is preferably made for film cooling for the leading edge LE, the trailing edge TE and the side sections SW according to FIGS. 5 and 6. For this purpose, cooling holes 19, 19', 20, 20', 25 and 26 lead outwards from the impingement cooling cavities 17, 18 and lead into the outer space. The cooling holes 25 and 26 in the side sections SW (as seen in the circumferential direction) are arranged in a staggered manner in relation to each other so that the discharging air in the adjoining heat shield segments 11 is not mutually impeded at the outlet.

In the leading edge section LE and in the side section SW, the cooling holes 20, 20' and 25, 26 are arranged on the end faces in a set-back manner by means of corresponding recesses 22, 23 and 24 so that when the component makes contact with the adjacent component the air can still discharge without being impeded. The cooling holes 19', 20' are flared in the region of the corners of the heat shield segment 11 (flared cooling holes) in order to optimally cool the edge regions.

Figure 7:
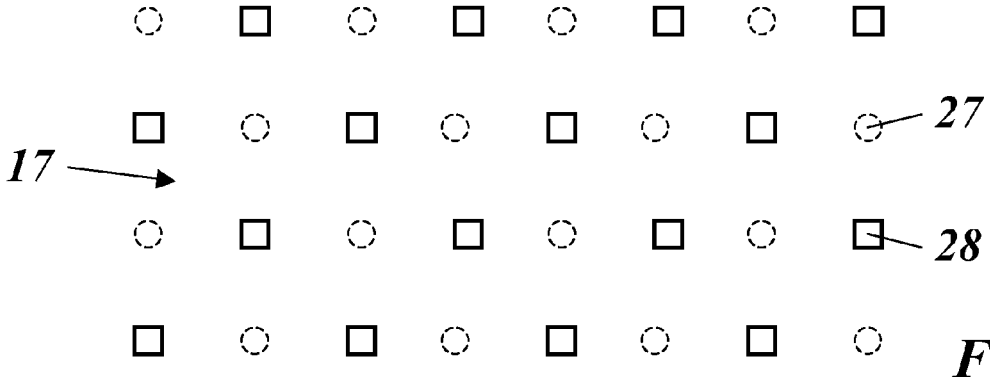
FIG. 7 shows the arrangement of pillars in the impingement cooling cavities of the heat shield segment, according to another exemplary embodiment of the invention.
Figure 8:
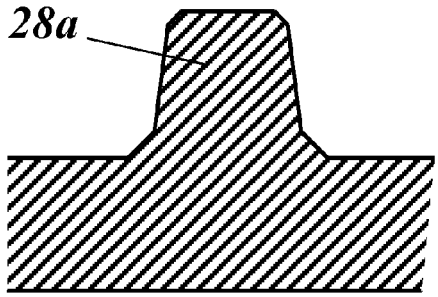
FIG. 8 shows in longitudinal section one of the possible pillars from FIG. 7, which is provided as a spacer for the impingement cooling plates.
Figure 9:
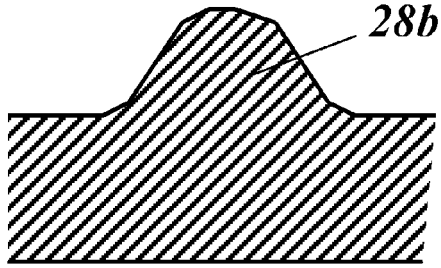
FIG. 9 shows in longitudinal section another of the possible pillars from FIG. 7, which is provided as a cooling pin with additional heat transfer surfaces.
Figure 10:
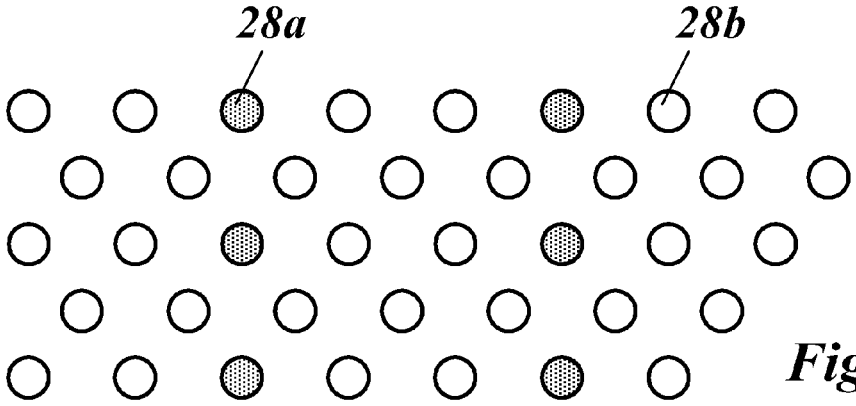
FIG. 10 shows a preferred distribution of the pillars from FIGS. 8 and 9 in the impingement cooling cavities.

The impingement cooling can be further improved if according to FIG. 7 provision is made in the impingement cooling cavities 17, 18 for additional conical pillars 28 which, staggered with the holes 27, are arranged in a distributed manner in the impingement cooling plates. The combination of impingement cooling with two types of conical pillars 28 (FIGS. 8-10) is especially advantageous. One type of pillar (FIG. 8) is formed as a spacer 28*a* for the impingement cooling plates 15, 16. The other type of pillar (FIG. 9) serves as a cooling pin 28*b* for increasing the turbulence, the heat flow and the heat transfer surface. Both types of pillars, that is to say the spacers 28*a* and the cooling pins 28*b*, can be arranged in a staggered manner according to FIG. 10 for increasing the transfer of heat.

Figure 11:
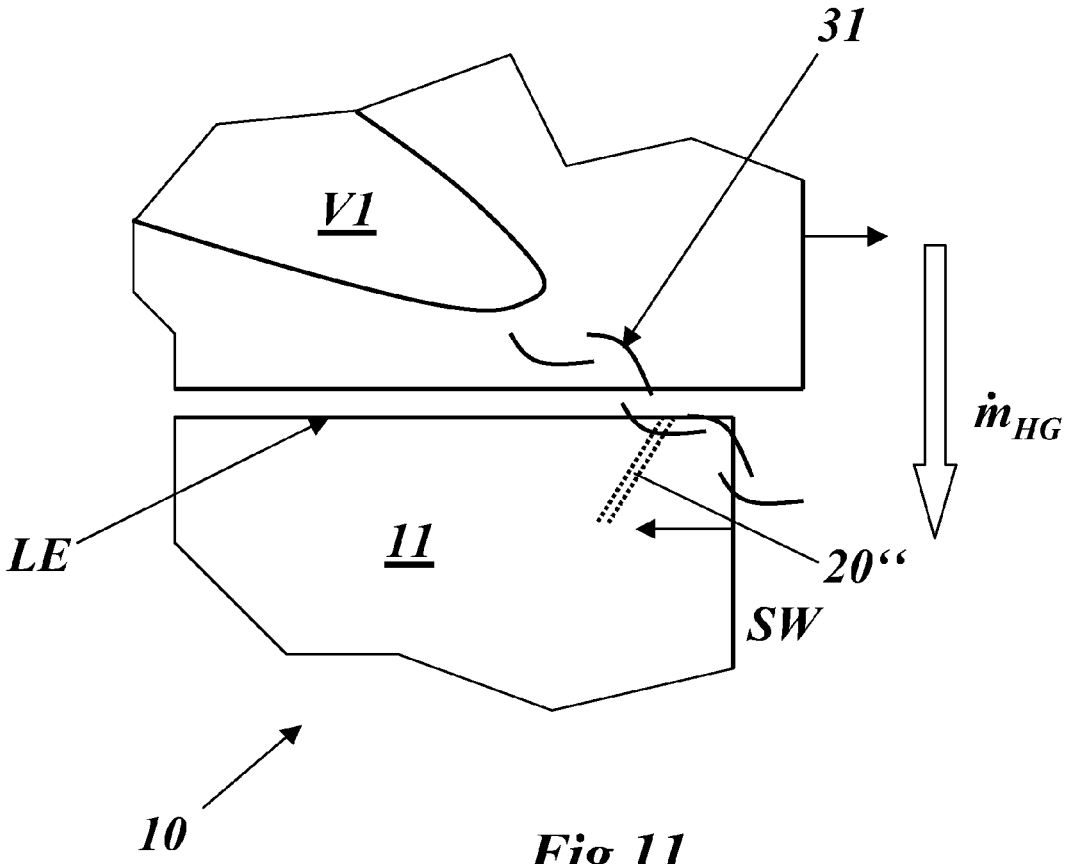
FIG. 11 shows, as seen in the radial direction, the relative positioning of stator blade and heat shield segment in the circumferential direction which is important for the pressure margin.

In the region behind the previous stator blade V1, where the wake in the form of a wake pressure wave 31 moves over the heat shield segment 11, specifically over the leading edge LE and the side edge SW (FIG. 11), the corresponding cooling holes 20" (dotted in FIGS. 4, 11) are fed with cooling medium (air) of higher pressure from above the impingement cooling plate 16 in order to increase the pressure margin. Since the pressure margin of all the cooling holes does not have to be increased, a significant performance advantage results.

In particular, by projecting or setting back the components 11, V1 in the parting plane in relation to each other, the wake pressure wave 31 is positioned on the heat shield segment 11 (displacement arrows in FIG. 11) so that the pressure margin of the cooling holes in the leading edges and in the side section, and of the annular gap and also the consumption of cooling air, are altogether optimally set.

The size of the impingement cooling cavities 17, 18 is selected so that optimum cooling occurs. The heat shield segment 11 is preferably provided with a ceramic thermal barrier coating (TBC), wherein different thicknesses and tolerances are selected in the regions upstream of the rotating-past of the rotor blade B1 and at the place where the rotor blade B1 moves past. For the region upstream of the rotating-past of the rotor blade B1, large thicknesses of the thermal barrier coating are selected in order to reduce the wake effect, and for the region where the rotor blade B1 moves past, however, small manufacturing tolerances are selected in order to minimize performance losses.

Figure 12:
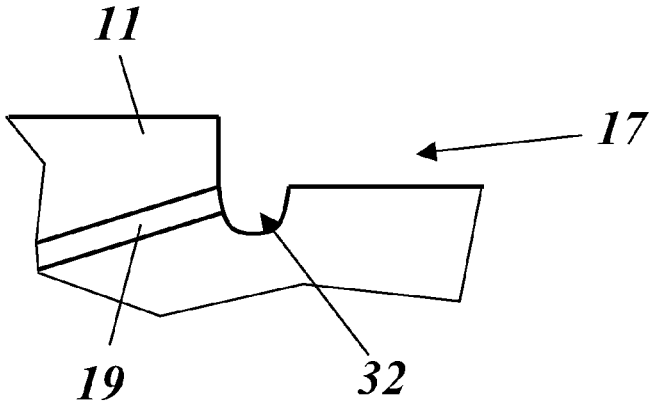
FIG. 12 shows an example of the local reduction of wall thickness by means of a slot where the cooling holes lead into the impingement cooling cavities.

The cooling holes 19, 19' 20, 20', 25, 26 are positioned as close as possible to the hot gas in the hot gas passage 29. Manufacturing tolerances and global wall thicknesses are subject to minimum criteria for rubbing and oxidation. Therefore, locally, where the cooling holes lead into the impingement cooling cavities, the wall thickness is preferably reduced by means of a slot 32 (FIG. 12).

| List of designations | |
|---|---|
| 10 | Gas turbine |
| 11 | Heat shield segment |
| 12, 13, 14 | Fastening element |
| 15, 16 | Impingement cooling plate |
| 17, 18 | Impingement cooling cavity |
| 19, 19' | Cooling hole |
| 20, 20', 20" | Cooling hole |
| 21 | Cover plate |
| 22, 23, 24 | Slot |
| 25, 26 | Cooling hole |
| 27 | Hole |
| 28 | Pillar |
| 28a | Spacer |
| 28b | Cooling pin |
| 29 | Hot gas passage |

-continued

| List of designations | |
|---|---|
| 30 | Annular cavity |
| 31 | Wake pressure wave |
| 32 | Slot |
| B1 | Rotor blade |
| LE | Leading edge |
| TE | Trailing edge |
| SW | Side section |
| $\dot{m}_c$ | Mass flow density (cooling air) |
| $\dot{m}_{HG}$ | Mass flow density (hot gas) |
| $P_1$, $P_2$ | Pressure (cooling air) |
| $P_{S,TE}$ | Pressure (trailing edge) |
| $P_{S,LE}$ | Pressure (leading edge) |
| V1, V2 | Stator blade |

What is claimed is:

1. A gas turbine, comprising a rotor, which is rotatable around an axis and equipped with rotor blades, the rotor being concentrically enclosed at a distance by a casing, the casing being equipped with stator blades, forming an annular hot gas passage, rings comprising the stator blades and the rotor blades are arranged in an alternating manner in an axial direction, between adjacent stator blades heat shield segments are arranged, which delimit the hot gas passage on its outside in a region of the rotor blades and are cooled by impingement cooling where a cooling medium from an outer annular cavity flows into the heat shield segment, the number of heat shield segments and adjacent stator blades in the rings are the same.

2. The gas turbine as claimed in claim 1, wherein two impingement cooling cavities, into which the cooling medium from the annular cavity flows, are arranged in the heat shield segment in each case in series in the axial direction.

3. The gas turbine as claimed in claim 2, wherein a downstream-disposed impingement cooling cavity is separated from the annular cavity and both cooling cavities can be exposed to admission of the cooling medium at the same pressure.

4. The gas turbine as claimed in claim 3, wherein the heat shield segments in each case have a middle, hook-like fastening element, the two impingement cooling cavities are separated from each other by the middle fastening element, and the downstream-disposed impingement cooling cavity is separated from the annular cavity by a cover plate which is arranged between the downstream-disposed impingement cooling cavity and annular cavity.

5. The gas turbine as claimed in claim 2, wherein a multiplicity of pillars are arranged in a distributed manner in the impingement cooling cavities for increasing the transfer of heat.

6. The gas turbine as claimed in claim 5, wherein the multiplicity of pillars comprise spacers for impingement cooling plates and cooling pins for increasing the transfer of heat between cooling medium and heat shield segment.

7. The gas turbine as claimed in claim 6, wherein the pillars are accommodated in the impingement cooling cavities in arrangements which are regular at least in sections, and in that the spacers and cooling pins are arranged in a staggered manner in relation to each other.

8. The gas turbine as claimed in claim 2, wherein the heat shield segments have a leading edge, a trailing edge and two side sections in each case with regard to the flow of the hot gas, and for film cooling of the edges and side sections of the heat shield segment, cooling holes are provided, which, extending from the impingement cooling cavities, pass through the heat shield segment to all sides and terminate externally thereto.

9. The gas turbine as claimed in claim 8, wherein the cooling holes, which terminate on oppositely disposed side sections of the heat shield segment, are arranged in a staggered manner in relation to each other so that the discharging cooling medium in adjoining heat shield segments is not mutually impeded at an outlet.

10. The gas turbine as claimed in claim 8, wherein the cooling holes at the leading edge and in the side sections terminate in a set-back manner in a recess to allow unimpeded discharging of the cooling medium.

11. The gas turbine as claimed in claim 8, wherein the cooling holes in a region of corners of the heat shield segment are formed in a flared manner for improved cooling of edge regions.

12. The gas turbine as claimed in claim 8, wherein each heat shield segment and upstream-disposed stator blade associated therewith are positioned relative to each other in a circumferential direction so that a wake pressure wave, which is created by the stator blade, is compensated by a corresponding arrangement and supply of the cooling holes.

13. The gas turbine as claimed in claim 12, wherein the cooling holes are located in a region of the wake pressure wave, above impingement cooling plates, and lead into the impingement cooling cavities.

* * * * *